US009968939B2

(12) United States Patent
Berglitsch

(10) Patent No.: US 9,968,939 B2
(45) Date of Patent: May 15, 2018

(54) SHREDDING DEVICE

(71) Applicant: MANUEL LINDNER, Spittal/Drau (AT)

(72) Inventor: Siegfried Berglitsch, Villach (AT)

(73) Assignee: MANUEL LINDNER, Spittal/Drau (AT)

( * ) Notice: Subject to any disclaimer, the term of this patent is extended or adjusted under 35 U.S.C. 154(b) by 676 days.

(21) Appl. No.: 14/497,862

(22) Filed: Sep. 26, 2014

(65) Prior Publication Data

US 2015/0129697 A1 May 14, 2015

(30) Foreign Application Priority Data

Oct. 4, 2013 (EP) ..... 13187384

(51) Int. Cl.

| | |
|---|---|
| ***B02C 18/00*** | (2006.01) |
| ***B02C 18/22*** | (2006.01) |
| ***B02C 18/18*** | (2006.01) |
| *B02C 13/286* | (2006.01) |

(52) U.S. Cl.

CPC ..... *B02C 18/2291* (2013.01); *B02C 18/18* (2013.01); *B02C 18/2233* (2013.01); *B02C 2013/28627* (2013.01); *B02C 2013/28672* (2013.01); *B02C 2018/188* (2013.01)

(58) Field of Classification Search

CPC .. B02C 18/2291; B02C 18/2233; B02C 18/18
USPC ..... 241/224, 285.2, 285.3, 280
See application file for complete search history.

(56) References Cited

U.S. PATENT DOCUMENTS 3,756,519 A * 9/1973 Reynolds ..... B02C 18/14 241/100
4,043,514 A * 8/1977 Peterson, Jr. ..... B02C 23/04 241/285.3
4,394,984 A * 7/1983 Hight ..... B02C 18/143 241/278.1

(Continued)

FOREIGN PATENT DOCUMENTS

CN 201002039 Y 1/2008
CN 103316749 A 9/2013

(Continued)

OTHER PUBLICATIONS

Chinese Office Action issued by SIPO dated Jul. 18, 2016, for corresponding Chinese Patent Application No. 201410513783.3 (English language translation attached).

(Continued)

*Primary Examiner* — Faye Francis
(74) *Attorney, Agent, or Firm* — Moore & Van Allen PLLC; Henry B. Ward, III

(57) ABSTRACT

Shredding device for shredding material comprising a housing: a rotor and one or more counter blades which are arranged in the housing such that they interact for shredding the material; a pusher element that is movable such that it pushes the material to be shredded in the direction towards the rotor and the counter blades; a hopper for feeding the material which is arranged movable on the housing between a first and a second position, where, in its first position, the material may be fed to the rotor and the counter blades, and in its second position, the rotor and the counter blades are freely accessible from the exterior of the shredding device.

10 Claims, 2 Drawing Sheets

(56) References Cited

U.S. PATENT DOCUMENTS

| | | | | | |
|---|---|---|---|---|---|
| 5,273,218 | A * | 12/1993 | Burns | B02C 18/146 | 241/189.1 |
| 5,553,797 | A * | 9/1996 | Axelsson | B02C 18/148 | 241/285.3 |
| 5,695,134 | A * | 12/1997 | Williams | B02C 13/288 | 241/186.3 |
| 5,988,544 | A * | 11/1999 | Williams, Jr. | B02C 18/146 | 241/294 |
| 6,016,979 | A * | 1/2000 | Squires | B02C 18/145 | 241/280 |
| 6,405,949 | B1 * | 6/2002 | Maguire | B02C 18/148 | 241/242 |
| 7,578,463 | B2 * | 8/2009 | Sotsky | B02C 18/145 | 241/224 |
| 7,905,437 | B2 * | 3/2011 | Rota | B02C 18/142 | 241/224 |
| 2003/0089478 | A1 * | 5/2003 | Tanner | D21B 1/066 | 162/261 |
| 2008/0169369 | A1 | 7/2008 | Wang | | |
| 2015/0060583 | A1 * | 3/2015 | Boehlefeld | B02C 18/142 | 241/167 |

FOREIGN PATENT DOCUMENTS

| | | | |
|---|---|---|---|
| DE | 19700808 | A1 | 7/1998 |
| DE | 102012006650 | A1 | 12/2012 |
| WO | 2008112254 | A2 | 9/2008 |

OTHER PUBLICATIONS

Chinese Office Action issued by SIPO dated Apr. 25, 2017, for corresponding Chinese Patent Application No. 201410513783.3 (English language translation attached).

Extended European Search Report issued by the European Patent Office on Feb. 19, 2014, for corresponding European Patent Application No. EP 13187384.6 (English language translation attached).

Office Action issued by the European Patent Office dated Sep. 25, 2017, for corresponding European Patent Application No. EP 13187384.6 (English language translation attached).

Office Action issued by the European Patent Office dated Feb. 8, 2018, for corresponding European Patent Application No. EP 13187384.6 (English language translation attached).

* cited by examiner

SHREDDING DEVICE

FIELD OF THE INVENTION

The present invention relates to a shredding device for shredding material, in particular in the form of plastics or waste products.

BACKGROUND OF THE INVENTION

Commercial waste, industrial waste, domestic waste, etc., for example, (hard) plastics, textiles, composites. rubber or waste wood (such as pallets and chipboard), require shredding prior to their final disposal or prior to returning them into the recovered substance cycle of the shredding. Prior art knows single- or multiple-shaft shredders which are loaded, for example, by wheeled loaders, forklifts, conveyors, or manually via a hopper for material feed.

A central element of a conventional shredder is a rotor assembly comprising a rotor being fitted with tear hooks or blades, provided e.g. with concave milled round cutting crowns. The blades are fixed, for example, by being bolted onto blade carriers, that may be welded into blade recesses or e.g. bolted on, which are machined into the rotor.

The material fed may be pushed in the direction of the rotating rotor, for example, by a pusher device, in short referred to as a pusher element, which is controlled by load-sensing. After being shredded between the rotating blades and the counter blades, the material is typically discharged through a screen device which determines the shredding factor according to the screen size, and is conveyed on by a conveyor belt, a screw conveyor, a chain conveyor or an extractor system etc.

Regardless of the design, service and/or cleaning activities must be performed in a shredding device. Typical service activities include changing the shredding blades at the rotor and cleaning the inner space of the device. Access to the machine inner space for cleaning is in prior art possible only after time-consuming disassembly of machine components, such as hydraulic cylinders that move a pusher element or a service hatch. The area of the rotor and the counter blades is generally difficult to access.

In view of the problems mentioned, it is therefore an object of the present invention to provide a shredding device in which servicing and/or cleaning is facilitated over known prior art by reducing the required disassembly of components.

BRIEF SUMMARY OF THE INVENTION

The invention provides a shredding device for shredding material, comprising: a housing a rotor and one or more counter blades which are arranged in the housing such that they interact for shredding the material: a pusher element that is movable such that it pushes the material to be shredded in the direction towards the rotor and the counter blades; a hopper for feeding the material which is arranged movable on the housing between a first and a second position, where, in its first position, the material may be fed to the rotor and the counter blades, and in its second position, the rotor and the counter blades are freely accessible from the exterior of the shredding device.

The rotor and the one or more counter blades form a shredding or work area. In the work area, the rotor and the counter blades interact to shred the material. The rotor and the counter blades may be accessed very easily if the hopper for feeding the material is movable. The hopper can therefore be moved from a first position which is a work position of the device, and in particular of the hopper, to a second position, where the second position is a service and/or cleaning position of the device. By moving the hopper to the second position, the rotor and the counter blades are freely accessible from the exterior of the device. This means, a user of the system wanting to perform servicing/cleaning for the rotor and/or counter blades therefore has free access to the rotor and the counter knives, i.e. to the work area. Access is there possible in particular through an opening in the housing of the device through which the material to be shredded previously passes from the hopper into the inner space of the housing of the device. For example, the material to be shredded there drops into the inner space of the housing of the device.

In the shredding device the hopper may be slidable relative to the housing.

Due to the slidability of the hopper relative to the housing, the hopper can in a particularly simple manner be slid relative to the housing from the first position to the second position. The hopper can thereby also be slid in a particularly simple manner back into the first position.

In the shredding device, one or more guide grooves or rails may be provided on the housing for guiding the hopper.

The guide rails or guide grooves on the housing enable moving the hopper such that it is slid on the housing in a guided manner. The motion of the hopper can thereby in particular be well defined from the first position to the second position. The hopper can additionally be secured, for example, via the guide rails such that it can during sliding not detach from the housing, i.e. from the housing surface.

In the shredding device, a drive for moving the hopper may be provided, wherein the drive may be configured as a linear drive.

Moving the hopper can advantageously be effected by a drive. Since the mass of the hopper can usually be large, movement of the hopper relative to the housing may be ensured as precisely as possible by a drive. This can in particular be effected by a linear drive. The translational motion of the hopper can thereby be ensured from the first position to the second position following a predetermined path.

In the shredding device the hopper ay be farmed pivotable on a pivot axle.

A pivotable hopper on a pivot axle may be pivoted out of the first position and pivoted into the second position. Simple access can thereby be gained to the rotor and/or the counter blades. By pivoting the hopper about a picot axle, the motion of the hopper may be restricted to the pivot path, whereby precise movement of the hopper may be ensured.

A driver may be provided in the shredding device for pivoting the hopper he pivot axle.

When the hopper is pivoted about the pivot axle, a drive can also be used to pivot the hopper in a controlled manner from the first position to the second, position. The same applies when the hopper, after the rotor and/or the counter blades have been cleaned, is pivoted back again to the first position, i.e. to the work position.

In the shredding device, the drive may be designed to be mechanic and/or pneumatic and/or hydraulic and/or a chain drive.

Different types of drives, such as a mechanic and/or a pneumatic and or a hydraulic drive and/or a chain drive, may be used depending on specific usage requirements. These types of drives can in particular also be combined.

In the shredding device the hopper may be coupleable with the pusher element in such a manner that the hopper is movable by movement of the pusher element.

When the hopper is coupled to the pusher element, then the hopper may be moved by controlling the pusher element. Due to the coupling, the drive of the pusher element can in combination move both the pusher element as well as the hopper. This results in a particularly simple and compact design of the device. Coupling may be effected manually by a coupling member, such as a connector, For example, a coupling member may be provided that may be hooked to the pusher element and/or to the hopper. It can also be possible to provide an electromagnetic or hydraulic coupling. When the pusher element moves to the second position, i.e. when the pusher element moves away from the rotor and the counter blades, it can thereby move the hopper along in an effective manner. The hopper and the pusher element there typically move in the same direction.

In the shredding device the pusher element may be coupled to the hopper in the first position.

Coupling can advantageously be effected in the first position. The pusher element commonly operates independently from the hopper during the normal shredding action of the shredding device. For the purpose of servicing or cleaning the work area, the pusher element may be moved to a position where the head of the pusher element is close to the rotor and the counter blades, i.e. the pusher element is moved far or even to the maximum in the direction towards the rotor, is, for example, extended in full. Coupling the pusher element to the hopper, which is located in the above-defined first position, can ensure that the pusher element has a particularly long stroke to move the hopper when the pusher element moves to the second position.

In the shredding device, the pusher element may be movable by a further drive that may be designed as being mechanic and/or pneumatic and/or hydraulic and/or as a chain drive.

Depending on the application it may also be advantageous to drive the pusher element and the hopper independently of each other, which may be advantageous in particular when the sizes of the pusher element and the hopper differ greatly. A further drive may be used for this.

A pusher element may be provided in the shredding device such that it remains entirely within the housing during the shredding operation.

This allows the shredding device to be designed in a very compact manner.

The shredding device may be a single-shaft shredder with a stationary counter blade or counter blades, or a multi-shaft shredder with a counter blade or counter blades arranged on a further rotor.

The shredding device can also comprise various common types of single-shaft or multi-shaft shredders and can therefore be adapted to various usages requirements.

BRIEF DESCRIPTION OF THE DRAWINGS

Further features and exemplary embodiments of the present invention are illustrated in more detail below using the figures. It is understood that the embodiments do not exhaust the scope of the present invention. It is further understood that some or all features described hereafter can also be combined with each other in different ways.

DETAILED DESCRIPTION OF THE INVENTION

Figure 1:
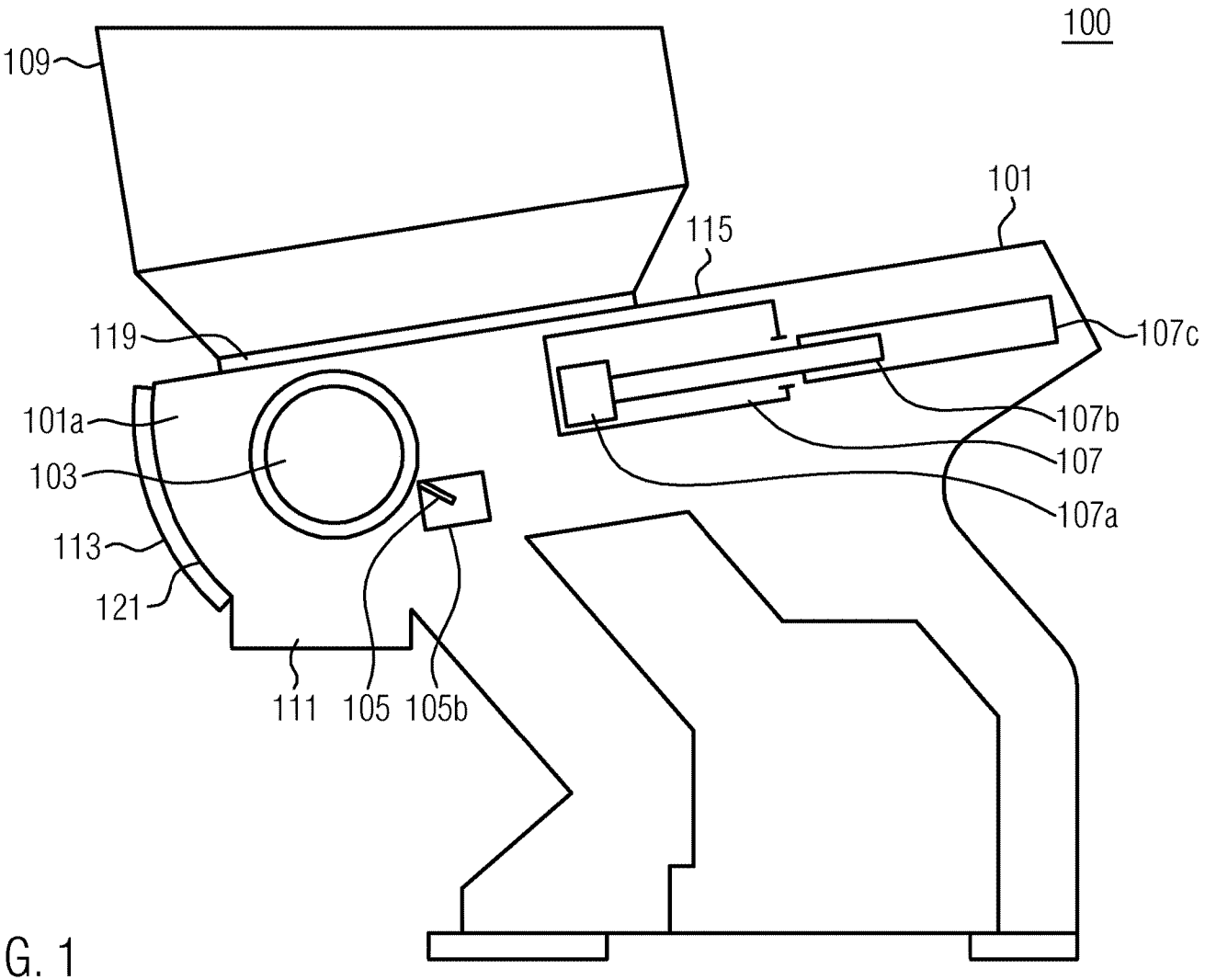
FIG. 1 schematically shows a view of a shredding device according to the present invention, FIG. 2 schematically shows the shredding device of FIG. 1 according the present invention in a servicing position.

FIG. 1 shows a shredding device 100 according to the invention. The shredding device 100 comprises a housing 101, a rotor 103, and at least one counter blade 105. The counter blade or blades 105 can for example be attached to a block-like counter element assembly 105*b*. It is understood that more than one counter blade 105 may be used. The material to be shredded, for example plastic, is received in the shredding device 100 through a hopper 109 and from there fed to the rotor 103 and the at least one counter blade 105. The material may be moved, for example, by the force of gravity acting upon the material from the hopper 109 in the direction towards the rotor 103. The hopper 109 is in FIG. 1 located in the housing 101. It is to be understood that the housing 101 is provided with a suitable opening 119 through which the material can pass from the hopper 109 into the inner space 101 of the housing. The material is then shred by interaction of the rotor 103 and the at least one counter blade 105. The region in which the rotor 103 and the counter blade or counter blades 105 interact and shred the material can also be referred to as the work area or the shredding area of the shredding device 100.

In FIG. 1, the shredded material may be discharged through a screen device 111 and be collected and transported outside of the shredding device 100, e.g. to be recycled.

FIG. 1 further shows a pusher element 107 The pusher element is provided in the housing 101 of the shredding device 100. The pusher element 107 is movable such that it pushes the material to be shredded in the direction towards the rotor 103 and the counter blade or blades 105. The material to be shredded is therefore by the pusher element 107 pushed towards or into the work area. This significantly increases the efficiency of the shredding process.

Purely by way of example, FIG. 1 shows a hydraulic drive 107*a*, 107*b* and 107*c* of the pusher element 107. Reference numeral 107*a* there denotes a pusher piston. Reference numeral 107*b* denotes a piston rod of the pusher element. Reference numeral 107*c* denotes a hydraulic cylinder for hydraulic guidance and the piston rod 107*b* and for driving the pusher element 107. However, other configurations are also possible (not shown in FIG. 1) in which the drive 107 may be formed to be mechanic or pneumatic or as a chain drive, A combination of mechanic and or pneumatic and tor hydraulic elements and or chain drive elements is also possible.

FIG. 1 also outlines a guide rail 115. It is to be understood that the guide rail 115 is outlined purely by way of example and that several guide rails may be used just as well. Guide groves can additionally or alternatively also be used for guiding the hopper 109. The hopper 109 in FIG. 1 is provided movable on the housing 101, so that it can in the event of servicing be moved from a work position, shown in FIG. 1, to a second position. The guide rail 115 enables moving the hopper 109 on the housing 101 in a guided manner. The motion of the hopper 109 can thereby be defined particularly well from the first position, the work position, to the second position. The hopper 101 can additionally be secured via the guide rail 115 such that it can during sliding not detach from the housing 101, i.e. from the housing surface.

FIG. 1 by way of example shows that the pusher element remains entirely within the shredding device 100, at least during the shredding process. This allows providing a particularly compact device 100.

FIG. 1 also optionally shows a service hatch 113 which is provided laterally at the housing on a wall 121 of the housing 101 This service hatch can provide additional lateral access to the inner space 101*a* and to the rotor 103. But no service hatch 113 can just as well be provided in the device, and the wall 121 of the housing 101 may be provided as a common housing wall without any opening.

Figure 2:
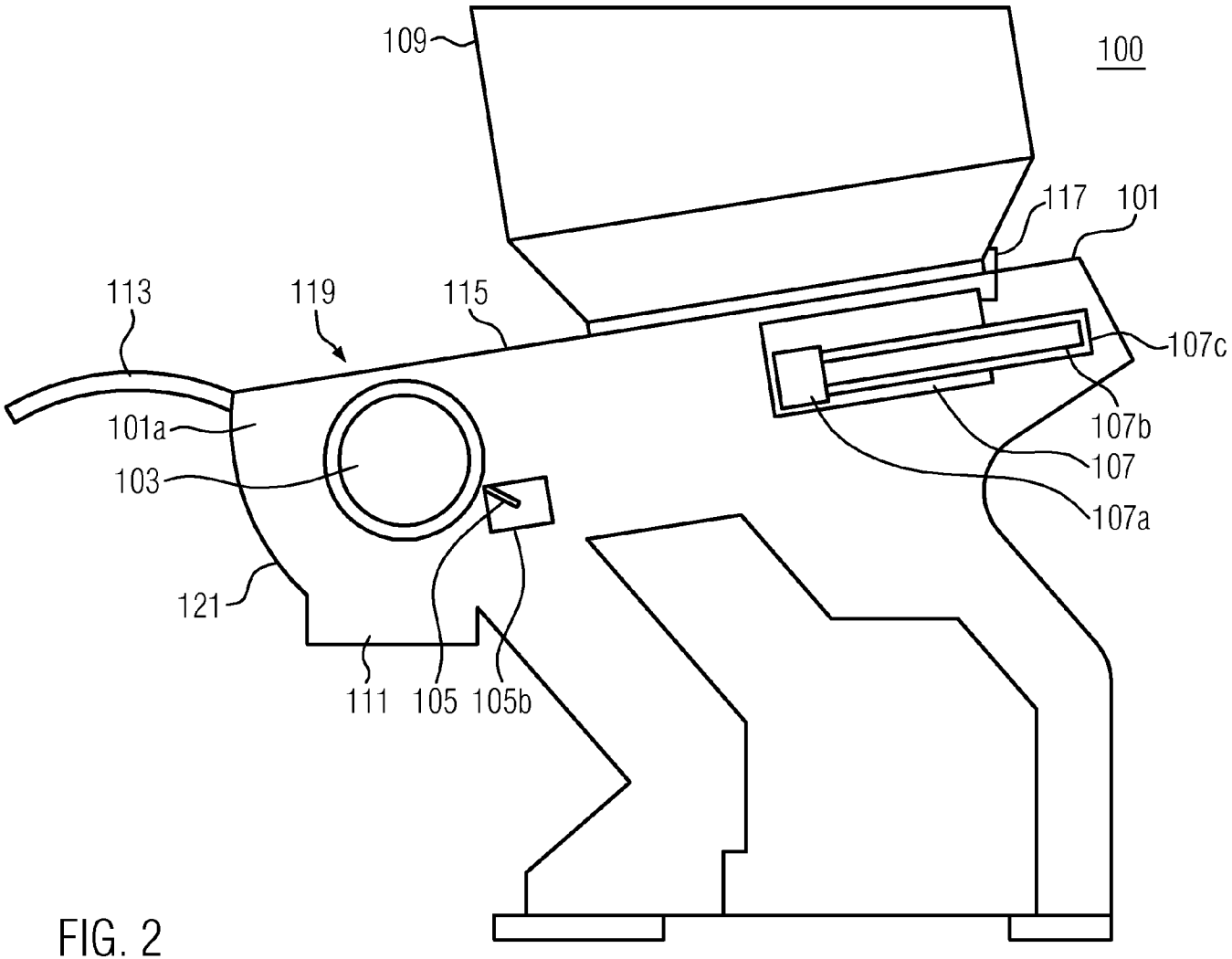

In FIG. 2, same elements are denoted with the same reference numerals as in FIG. 1.

FIG. 2 shows the hopper 109 of the shredding device 100 such that the hopper 109 is located in the second position. The shredding device 100 is thereby in a location or position that is suitable for servicing or cleaning the device. The inner space 101*a* of the housing 101 and in particular the work area of the rotor 103 and the counter blade or blades 105 are thereby freely accessible from the exterior. The work area, and therefore the rotor 103 and the counter blade or blades 105, can thereby be directly accessed through the opening 119 in a simple manner for being able to performing servicing or cleaning in this area.

The hopper 109 is in FIG. 2 coupled to the pusher element 107. Purely by way of example, a coupling element or a coupling assembly 117 is shown in FIG. 2 that provides the coupling between the pusher element 107 and the hopper 109. The coupling of the pusher element 107 and the hopper 109 by use of the coupling element 117 can in the simplest case be effected manually. But other coupling options are also conceivable, such as an electromagnetic coupling or a hydraulic coupling. By coupling the hopper 109 to the pusher element 107, the drive 107*a*, 107*b*, 107*c* of the pusher element 107 can also move the hopper 109 practically together with the pusher element 107. The motion of the pusher element 107 and the hopper 109 is in this example effected in the same direction. The hopper element 109 is in the embodiment of FIGS. 1 and 2 guided on at least one guide rail. It is understood that a suitable controller can control the motion of the pusher element 107 and the hopper 109.

The additional optional service hatch 113 is in FIG. 2 further shown in an open position, so that lateral access is possible through the housing wall 121.

It is understood that further embodiments (presently not shown) are also possible in which the hopper element 109 comprises a separate drive, whereby the hopper 109 and the pusher element 107 are driven independently.

It is also possible not to guide the hopper 109 on a rail, but to configure it pivotable on a pivot axle (not shown). The hopper 109 can thereby be pivoted away from the opening 119, It is for this purpose also conceivable to provide a coupling with the drive of the pusher element 107 that suitably deflected ensures the pivot motion of the hopper 109 from the first position to a second position.

In FIGS. 1 and 2, the shredding device is shown as a single-shaft shredder with a rotor 103 and counter blades 105 which are configured as being static on a counter blade block 105*b*.

The present invention, however, can also be transferred to a two or to multi-shaft shredder with more that one rotor. The shredding area, i.e. the rotors, can also with such embodiments be made accessible for servicing in a simple manner by moving the hopper on or relative to the housing.

The invention claimed is:

1. Shredding device for shredding material, comprising:

a housing;

a rotor and one or more counter blades, the rotor and the one or more counter blades being arranged in said housing such that they interact for shredding said material;

a pusher element which is movable such that it pushes said material for shredding in the direction towards said rotor and said one or more counter blades;

a hopper for supplying said material, the hopper being movable on and slidable relative to said housing and being disposed between a first and a second position, the first position being a working position of the device and the second position being a service position of the device;

a coupling element for directly coupling said pusher element to said hopper, wherein the direct coupling of said pusher element to said hopper provides for said hopper to be moveable by moving said pusher element; and wherein, when the hopper is in its first position, said material may be fed to said rotor and said counter blades in said housing and, when the hopper is in its second position, said rotor and said counter blades are freely accessible from an exterior of said shredding device.

2. Shredding device according to claim 1, with one or more guide grooves or rails being provided on said housing for guiding said hopper.

3. Shredding device according to claim 1, further comprising a drive for moving said hopper, where said drive is designed as a linear drive.

4. Shredding device according to claim 1, where said hopper is pivotable on a pivot axle.

5. Shredding device according to claim 4, further comprising a drive for pivoting said hopper about said pivot axle.

6. Shredding device according to claim 5, where said drive is designed to be mechanic and/or pneumatic and/or hydraulic and/or a chain drive.

7. Shredding device according to claim 1, where said pusher element may be coupled to said hopper in the first position.

8. Shredding device according to claim 1, where said pusher element is movable by a further drive that is designed to be mechanic and/or pneumatic and/or hydraulic and/ or a chain drive.

9. Shredding device according to claim 1, where said pusher element is provided such that it remains entirely within said housing during the shredding operation.

10. Shredding device according to claim 1, where said shredding device is a single-shaft shredder with a stationary counter blade or counter blades or a multi-shaft shredder with a counter blade or counter blades arranged on a further rotor.

* * * * *